United States Patent [19]

Mizutani et al.

[11] 4,028,097

[45] June 7, 1977

[54] SELF-LUBRICATING IRON BASE ALLOY

[75] Inventors: Yoshiyuki Mizutani; Masaaki Tada; Yasuo Imada, all of Nagoya, Japan

[73] Assignee: Kabushiki Kaisha Toyota Chuo Kenkyusho, Nagoya, Japan

[22] Filed: Feb. 3, 1976

[21] Appl. No.: 654,689

Related U.S. Application Data

[63] Continuation-in-part of Ser. No. 447,109, Feb. 28, 1974, abandoned.

[30] Foreign Application Priority Data

Mar. 2, 1973 Japan ..... 47-25485

[52] U.S. Cl. ..... 75/123 AA; 75/123 G; 75/123 J

[51] Int. Cl.[2] ..... C22C 38/12; C22C 38/60

[58] Field of Search ..... 75/123 AA, 123 J, 123 G

[56] References Cited

UNITED STATES PATENTS

| | | | |
|---|---|---|---|
| 1,846,140 | 2/1932 | Palmer | 75/123 AA |
| 2,009,713 | 7/1935 | Palmer | 75/123 AA |
| 2,009,714 | 7/1935 | Palmer | 75/123 AA |
| 2,781,258 | 2/1957 | Niedzwiedski | 75/123 AA |
| 2,914,400 | 11/1959 | Roberts | 75/123 J |
| 3,825,416 | 7/1974 | Mizutani et al. | 75/123 G |
| 3,856,478 | 12/1974 | Iwata et al. | 75/123 J |

OTHER PUBLICATIONS

Alloys of Iron and Molybdenum, Gregg, 1932, McGraw Hill Co., N.Y., pp. 107–114, 147–150.

*Primary Examiner*—Arthur J. Steiner
*Attorney, Agent, or Firm*—Blum, Moscovitz, Friedman & Kaplan

[57] ABSTRACT

The coefficient-of-friction of iron base alloys containing molybdenum is lowered by incorporation of sulphur or selenium. The wear resistance is greatly increased by adding carbon with little if any increase in the coefficient-of-friction. A method of preparation is disclosed.

3 Claims, 7 Drawing Figures

SELF-LUBRICATING IRON BASE ALLOY

CROSS REFERENCE TO RELATED APPLICATION

The present application is a continuation-in-part application of our co-pending application Ser. No. 447,109, filed Feb. 28, 1974 for A SELF-LUBRICATING IRON BASE ALLOY, now abandoned.

BACKGROUND OF THE INVENTION

This invention relates to an iron base alloy having a high lubricating characteristic and excellent wear resistance.

In general, compounds of sulphur or selenium with a metal selected from Group IVb, Vb and VIb of the periodic table are known to be excellent lubricants. Examples are compounds with titanium ($TiS_2$, $TiSe_2$), compounds with zirconium ($ZrS_2$, $ZrSe_2$), compounds with vanadium ($VS_2$, $VSe_2$), compounds with tantalum ($TaS_2$, $TaSe_2$), compounds with molybdenum ($MoS_2$, $MoSe_2$) and compounds with tungsten ($WS_2$ $WSe_2$). These compounds have a low friction characteristic and are used in practice as lubricants in the following forms:

1. a solid coating applied on the surface of a material to be subjected to friction;
2. a solid composite material in which the sulphide or selenide is bonded in the form of a layer on a base metal using an adhesive such as an organic resin; and
3. a solution in a liquid lubricant.

However, the compounds listed when used as described above have the following serious drawbacks, the drawbacks being listed in the same order as above:

1. A coating tends to flake or peel from a base metal so that the lubrication characteristic decreases with wear.
2. When incorporated in a resin, the compounds have a low heat resistance, so that friction which raises the temperature of the composition results in thermal decomposition.
3. Segregation of the selenide or sulphide in the liquid is likely to occur, as a result of which the lubricating at the frictional interface, so that severe wear of the metal which it is desired to protect may occur.

As is disclosed in the aforenoted application the present inventors overcame the listed drawbacks by providing a base metal alloy having a low coefficient of friction. In pursuit of this objective it was established that an iron base alloy containing from 5% to 30% (by weight, and the same hereinafter) of one or more metals of titanium, zirconium, vanadium, niobium, tantalum, molybdenum and tungsten, and from 0.5% to 5% of either sulphur or selenium could provide the excellent lubricating characteristic. In the above iron base alloy, the base metal itself has a lubricating characteristic thereby eliminating the danger of flaking or peeling which arises when a coating of a lubricant is used. However, such alloys could benefit from increased wear resistance.

SUMMARY OF THE INVENTION

This invention relates to an iron base alloy containing molybdenum, either sulphur or selenium, and carbon, the content of each element being so selected that carbon will not increase the coefficient of friction of the alloy, sulphur or selenium will not impair workability, and molybdenum will contribute in improving lubricity and wear resistance of the alloy, when combined with sulphur or selenium and carbon to form chemical compounds. Namely, the relative quantities of molybdenum, sulphur or selenium and carbon are such that molybdenum can form a carbide thereof with the total quantity of carbon present and, in addition, an amount of a compound with sulphur or selenium effective for conferring self-lubricity on the alloy. The present invention provides an iron-base alloy consisting essentially of 15 to 30% by weight of molybdenum, 1 to 5% by weight of either sulphur or selenium, and 0.5 to 1.2% by weight of carbon. Alloys according to the present invention present excellent self-lubricity and wear resistance.

Alloys in accordance with the invention are prepared by melting electrolytic iron and an iron-carbon alloy, adding molybdenum as an iron-molybdenum alloy, adding S or Se as FeS or FeSe, respectively, deoxidizing with aluminum and casting.

Accordingly, an object of the present invention is an iron base alloy having a low-coefficient of resistance and superior wear resistance.

Another object of the present invention is an iron base alloy containing molybdenum wherein a low coefficient-of-friction is obtained by addition of sulphur or selenium.

A further object of the present invention is an iron base alloy containing molybdenum, and containing sulphur or selenium to provide a low coefficient-of-friction and carbon in quantity such as to provide superior wear resistance without increasing the coefficient-of-friction appreciably.

Yet another object of the present invention is a method of preparing an iron base alloy of low coefficient-of-friction and high wear-resistance.

Still other objects and advantages of the invention will in part be obvious and will in part be apparent from the specification.

The invention accordingly comprises the several steps and the relation of one or more of such steps with respect to each of the others, and the composition possessing the features, properties, and the relation of constituents, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
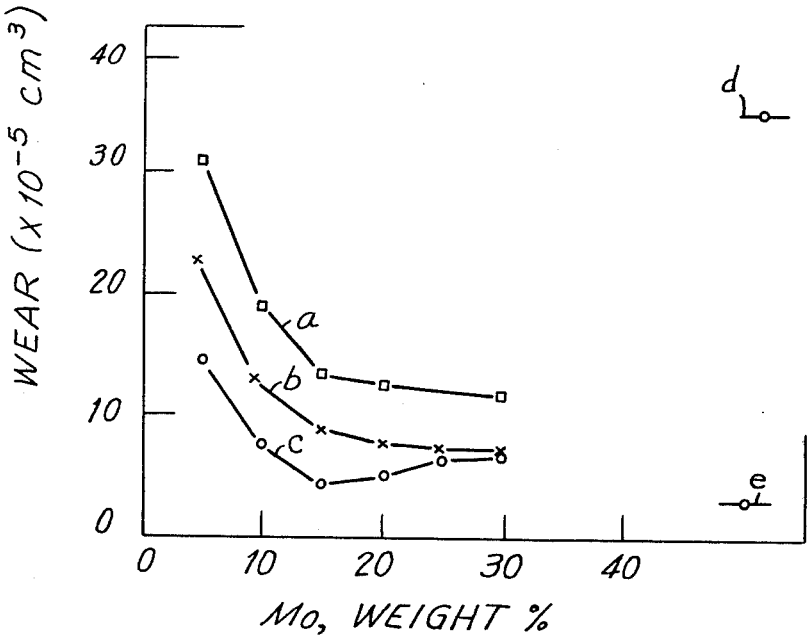
FIG. 1 is a plot showing the relationship of wear of alloys to molybdenum contents.

A number of alloys in accordance with the present ıvention were prepared as follows: Electrolytic iron nd an iron-carbon alloy were completely melted in a rucible with agitation. The quantity of iron-carbon lloy and the composition of said alloy were such as to rovide the quantity of carbon desired in the final comosition. Molybdenum was then added as an ironıolybdenum alloy (ferromolybdenum) to the melt in he crucible; sulphur or selenium was then added in the orm of FeS or FeSe under agitation until the added ıaterial was completely melted in the electrolytic iron. ıluminum was added as a deoxidizer and finally, the ıelt thus prepared was cast into a casting mold. The tructures of the alloys thus obtained were examined by ptical microscope, X-ray diffraction and EPMA analsis. Friction tests were carried out using a JIS (Japaese Industrial Standard) constant speed type friction ester at a friction speed of 7.9m/sec. and a pressure of kg/cm², and the metal against which the specimens ere pressed was hardened JIS S50C (carbon steel for ıachine structural use). Abrasion tests were made sing plate-and-ring type apparatus for wear testing at friction speed of 0.98m/sec., under final load of .3kg, with a friction distance of 200m, and the metal gainst which the specimens were pressed was hardned JIS SKDI (alloy tool steel).

The same tests were also made using JIS S45C (caron steel for machine structural use) and JIS SKH9 high speed tool steel) (hardened metals) for comparion.

The results obtained are shown in the Table and in IGS. 1–7. (Sample Nos. with the prefix C show comarative data for compositions outside the scope of the resent invention.)

TABLE

| Sample No. | Wt. % Fe Balance | Mo | S(Se)C | | Coefficient of friction (μ) | Wear: Wear (cm³) | Wear: Comparison with S45C(%) |
|---|---|---|---|---|---|---|---|
| 1 | " | 15 | 1S | 1.0 | 0.25 | $5.2 \times 10^{-5}$ | 14.9 |
| 2 | " | " | 1.5S | " | 0.22 | 4.5 | 12.9 |
| 3 | " | " | 3S | 0.5 | " | 9.3 | 26.7 |
| 4 | " | " | " | 0.7 | 0.20 | 7.5 | 21.6 |
| 5 | " | " | " | 1.0 | " | 4.4 | 12.6 |
| 6 | " | " | " | 1.2 | 0.21 | 3.3 | 9.5 |
| 7 | " | " | 4.5S | 1.0 | 0.19 | 6.8 | 19.5 |
| 8 | " | " | 5S | " | 0.19 | 7.2 | 20.7 |
| 9 | " | 20 | 1S | 0.5 | 0.24 | 8.9 | 25.6 |
| 10 | " | " | " | 1.0 | 0.26 | 5.2 | 14.9 |
| 11 | " | " | 1.5S | 0.5 | 0.22 | 9.0 | 25.9 |
| 12 | " | " | " | 1.0 | 0.20 | 5.2 | 14.9 |
| 13 | " | " | 3S | 0.5 | " | 8.9 | 25.6 |
| 14 | " | " | 3S | 0.7 | " | 8.6 | 24.7 |
| 15 | " | " | " | 1.0 | 0.21 | 5.0 | 14.4 |
| 16 | " | " | " | 1.2 | 0.26 | 2.1 | 6.0 |
| 17 | " | " | 4.5S | 0.5 | 0.20 | 10.0 | 28.7 |
| 18 | " | " | " | 1.0 | 0.19 | 6.0 | 17.3 |
| 19 | " | " | 5S | 0.5 | 0.20 | 10.9 | 31.3 |
| 20 | " | " | " | 1.0 | 0.19 | 6.5 | 18.7 |
| 21 | " | 25 | 3S | 0.5 | 0.20 | 7.6 | 21.8 |
| 22 | " | " | " | 1.0 | 0.23 | 6.4 | 18.4 |
| 23 | " | 30 | " | 0.5 | 0.22 | 7.8 | 22.4 |
| 24 | " | 30 | 3S | 1.0 | 0.26 | 6.6 | 19.0 |
| 25 | " | 15 | 1.5Se | 1.0 | 0.23 | 5.4 | 15.5 |
| 26 | " | " | 3Se | " | " | 5.1 | 14.7 |
| 27 | " | " | 4.5Se | " | " | 6.8 | 19.5 |
| 28 | " | 20 | 1.5Se | " | 0.25 | 4.3 | 12.3 |
| 29 | " | " | 3Se | " | 0.22 | 4.2 | 12.1 |
| 30 | " | " | 4.5Se | " | 0.21 | 5.0 | 14.4 |
| C1 | " | 5 | 3S | 0.3 | 0.35 | $30.8 \times 10^{-5}$ | 88.5 |
| C2 | " | " | " | 0.5 | 0.37 | 23.0 | 66.1 |
| C3 | " | " | " | 1.0 | 0.37 | 14.2 | 40.8 |
| C4 | " | 10 | 3S | 0.3 | 0.25 | 18.8 | 54.0 |
| C5 | " | " | " | 0.5 | 0.26 | 13.2 | 37.9 |
| C6 | " | " | " | 1.0 | 0.26 | 7.9 | 22.7 |
| C7 | " | 15 | 0.5S | " | 0.28 | 6.0 | 17.2 |

TABLE-continued

| Sample No. | Wt. % Fe Balance | Mo | S(Se)C | | Coefficient of friction (μ) | Wear: Wear (cm³) | Wear: Comparison with S45C(%) |
|---|---|---|---|---|---|---|---|
| C8 | " | " | 3S | — | 0.20 | 26.1 | 75.0 |
| C9 | " | " | " | 0.3 | 0.22 | 13.4 | 38.5 |
| C10 | " | " | " | 1.5 | 0.37 | 3.1 | 8.9 |
| C11 | " | " | 5.5S | 1.0 | 0.19 | 14.0 | 40.2 |
| C12 | " | 20 | 0.5S | 0.5 | 0.31 | 8.7 | 25.0 |
| C13 | " | " | " | 1.0 | 0.30 | 4.9 | 14.1 |
| C14 | " | " | 3S | — | 0.18 | 14.4 | 41.4 |
| C15 | " | " | " | 0.3 | 0.20 | 12.4 | 35.6 |
| C16 | " | 20 | 3S | 1.5 | 0.31 | 1.9 | 5.5 |
| C17 | " | " | 5.5S | 0.5 | 0.21 | 15.8 | 45.8 |
| C18 | " | " | " | 1.0 | 0.18 | 11.9 | 34.2 |
| C19 | " | 25 | 3S | 0.3 | 0.22 | — | — |
| C20 | " | 30 | " | 0.3 | 0.22 | 11.6 | 33.3 |
| C21 | " | 15 | 0.5Se | 1.0 | 0.29 | 6.0 | 17.2 |
| C22 | " | " | 5.5Se | " | 0.24 | 13.5 | 38.8 |
| C23 | " | 20 | 0.5Se | " | 0.32 | 4.7 | 13.5 |
| C24 | " | " | 5.5Se | " | " | 10.7 | 30.8 |
| C25 | S45C | | | | 0.45 | 34.8 | 100 |
| C26 | SKH9 | | (hardened metals) | | — | 2.7 | 7.8 |

FIG. 1 shows the relationship of the content of molybdenum in alloys to wear. The line *a* represents the result for Fe-xMo-3S-0.3C alloys ($x$=5, 10, 15, 20, 25, 30, corresponding to Sample Nos. C1, C4, C9, C15,C20 respectively); the line *b* represents Fe-xMo-3S-0.5C alloys ($x$ represents the same as above, corresponding to Sample Nos. C2, C5, 3, 13, 21, 23); the line *c* represents Fe-xMo-3S-1C alloys ($x$ represents the same as above, corresponding to Sample Nos. C3, C6, 5, 15, 22, 24) and lines *d* and *e* represent the wear of S45C and SKH9, respectively. As can be seen from FIG. 1, with the increase in content of molybdenum, wear of an alloy decreases, i.e., the wear resistance shows a tendency to increase, presenting pronounced improvement in wear resistance at molybdenum contents of about 15% or over. However, if the molybdenum content exceeds 30%, the resultant alloy is brittle. Comparison of the lines *a*, *b* and *c* as shown in FIG. 1 reveals that the greater the carbon content, the higher the wear resistance of an alloy. Thus, it can be seen from FIG. 1 that the greater the carbon and molybdenum contents, the higher will be the wear resistance of the alloy. It is considered that this can be attributed to iron-molybdenum intermetallic compound and molybdenum carbide formed in the alloy.

Figure 2:
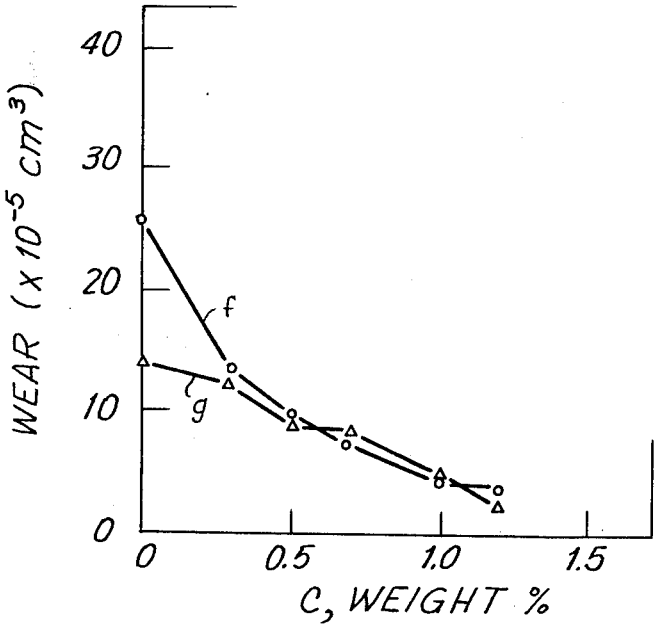
FIG. 2 is a plot showing the relationship of wear of alloys to carbon contents.

It is also apparent from FIG. 2 that the presence of carbon in an alloy improves the wear resistance. Line *f* shows Fe-15Mo-3S-xC alloys ($x = 0, 0.3, 0.5, 0.7, 1.0, 1.2$, Sample Nos. C8, C9, 3, 4, 5, 6), line *g* shows Fe-20Mo-3S-xC ($x$ designates the same as above, Sample Nos. C14, C15, 13, 14, 15, 16). FIG. 2 illustrates that the wear resistance of an alloy increases with the increase in carbon content and that a carbon content of about 0.5% or above present great improvement in wear resistance of an alloy over that of an alloy which contains no carbon, or which contains carbon in an amount lower than 0.5%. Carbon content of over 1.2% also presents improvement in wear resistance, but there will result an increase in the coefficient-of-friction with accompanied lower lubricity, which is contrary the objectives of the invention.

Figure 3:
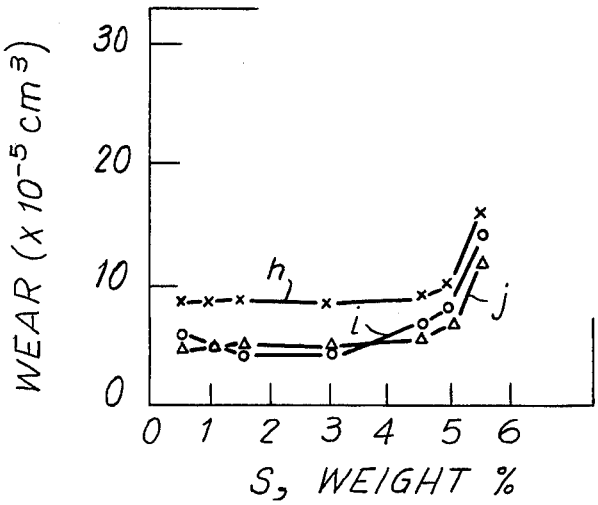
FIG. 3 is a plot showing the relationship of wear of alloys to sulphur contents.

FIG. 3 illustrates the relationship of sulphur content in an alloy to the wear. In this Figure, line *h* represents Fe-20Mo-xS-0.5C alloys ($x$ =0.5, 1, 1.5, 3, 4.5, 5, 5.5, Sample Nos. C12, 9, 11, 13, 17, 19, C17); line *i* represents Fe-15Mo-xS-1C alloys ($x$ represents the same as above, Sample Nos. C7, 1, 2, 5, 7, 8, C11); and line *j* shows Fe-20Mo-xS-1C (*x* represents the same as above. Sample Nos. C13, 10, 12, 15, 18, 20, C18). In each case, a sulphur content of 1% to 5% presents best wear resistance. It also shows that wear resistance increases with increase in content of carbon.

Figure 4:
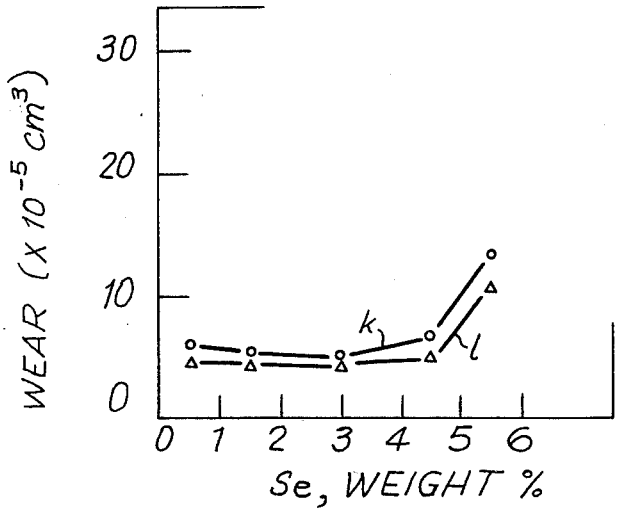
FIG. 4 is a plot showing the relationship of wear of alloys to selenium contents.

FIG. 4 shows the relationship of selenium content in an alloy to wear thereof. In this Figure, line *k* represents Fe-15Mo-xSe-1C ($x = 0.5, 1.5, 3, 4.5, 5.5$, Sample Nos. C21, 25, 26, 27, C22); and line *l* represents Fe-20Mo-xSe-1C alloys (*x* represents the same as above, Samples Nos. C23, 28, 29, 30, C24). FIG. 4 makes it evident that substitution of sulphur in an alloy by selenium will give similar results so far as wear resistance is concerned.

Figure 5:
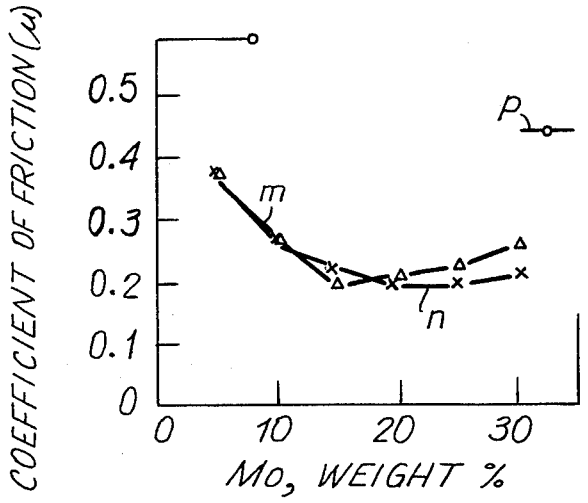
FIG. 5 is a plot showing the relationship of coefficients-of-friction of alloys to molybdenum contents.

FIG. 5 shows the relationship of molybdenum content in an alloy to coefficient of friction (lubricity). In this Figure, line *m* represents Fe-xMo-3S-1C alloys ($x =$ 5, 10, 15, 20, 25, 30, Sample Nos. C3, C6, 5, 15, 22, 24; and *n* does the same for Fe-xMo-3S-0.5C alloys (*x* represents the same as above, Sample Nos. C2, C5, 3, 13, 21, 23). Molybdenum contents of 10 to 30% result in a coefficient-of-friction which is considerably lower than that of S45C (point *p*). It has been recognized that molybdenum content in the aforesaid range results in the formation of molybdenum sulphide in such an amount that provides excellent lubricity. Also molybdenum carbide is formed. This Figure also reveals that the presence of carbon does not adversely affect the coefficient-of-friction of the alloys represented.

Figure 6:
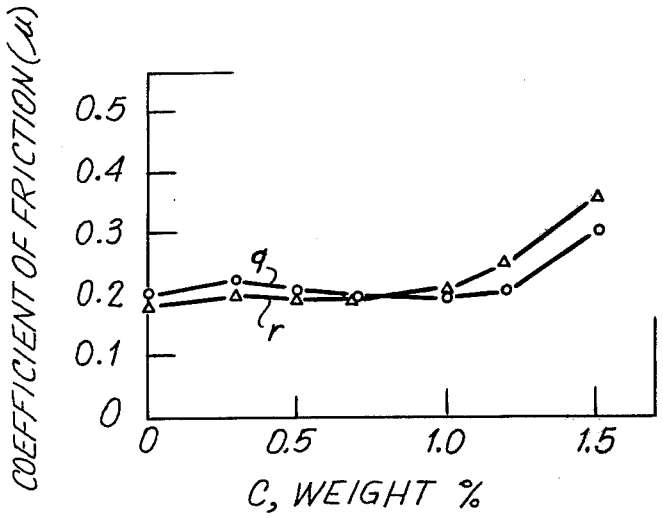
FIG. 6 is a plot showing the relationship of coefficients-of-friction of alloys to carbon contents.

It can be seen from FIG. 6 that a carbon content up to 1.2% presents little or no increase in coefficient-of-friction, but that at carbon contents higher than 1.2% the coefficient-of-friction increases. In this Figure, line *q* represents Fe-15Mo-3S-xC alloys ($x$=0, 0.3, 0.5, 0.7, 1.0, 1.2, 1.5, Sample Nos. C8, C9, 3, 4, 5, 6, C10) and line *r* represents Fe-20Mo-3S-xC alloys (*x* represents the same as above, Sample Nos. C14, C15, 13, 14, 15, 16, C16). It can be seen from this Figure that the coefficient-of-friction remains substantially constant within the claimed range, despite the increase in carbon content in the alloy. Nevertheless, the contribution of carbon to the improvement in wear resistant alloys containing same is substantial.

Figure 7:
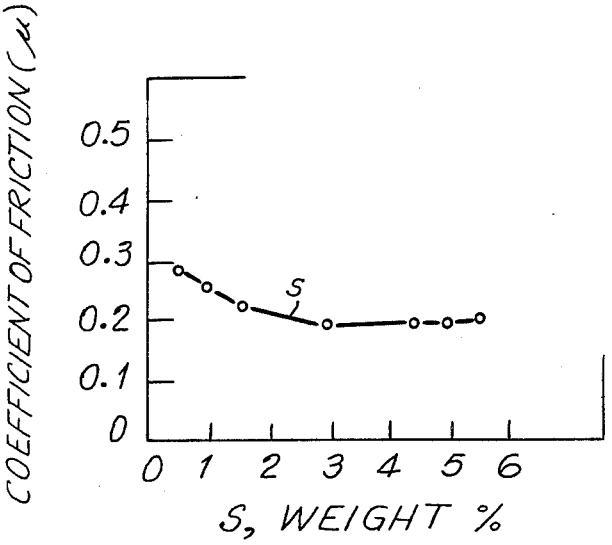
FIG. 7 is a plot showing the relationship of coefficients-of-friction of alloys to sulphur contents.

FIG. 7 shows the relationship of sulphur content in an alloy to coefficient-of-friction. In this Figure line *s* represents Fe-15Mo-xS-1C alloys ($x$= 0.5, 1, 1.5, 3, 4.5 5, 5.5, Sample Nos. C7, 1, 2, 5, 7, 8, C11). Furthermore Fe-20Mo-xS-1C, Fe-15Mo-xSe-1C, Fe-20Mo-xSe-1C alloys give results which are almost the same as represented by line *s*. It can be seen from this Figure that a sulphur (or selenium) content of 0.5% presents a relatively high coefficient-of-friction, while the increase of sulphur (or selenium) content to 1% lowers the coefficient-of-friction of the alloy substantially. Furthermore, a sulphur or selenium content of 3% or above brings about an almost constant coefficient-of-friction. Evidently, a sulphur (or selenium) content below 1% and specifically of 0.5% results in the formation of molybdenum sulphide (or selenide) of an insufficient amount, thus failing to provide good lubricity. On the other hand, at sulphur (or selenium) contents above 5%, the wear resistance decreases.

The results of the aforesaid experiments reveal that the addition of carbon to Fe-Mo-S (or Se) alloy improves wear resistance, and that alloys of a composition of from 0.5% to 1.2% carbon, from 1% to 5% sulphur (or selenium) and from 15% to 30% molybdenum, which is combined with sulphur (or selenium) and carbon to form sulphide (or selenide) and carbide thereof, present excellent self-lubricity and wear resistance without introducing any difficulty in maufacturing.

The aforesaid alloys according to the present invention present good heat resistance other than the aforesaid characteristics, and hence are adapted for use as materials for bearings, tools, etc. Particularly, they are best adapted for use as materials for members which are subjected to frictional sliding under a high load, because of the increase in strength of an alloy due to the addition of carbon thereto. interpreted It will thus be seen that the objects set forth above, amony those made apparent from the preceding description are efficiently attained and, since certain changes may be made in carrying out the above method and in the composition set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A self-lubricating wear-resistant iron base alloy consisting essentially of 15 to 30% by weight of molybdenum, 1 to 5% by weight of an element selected from the group consisting of sulphur and selenium, and 0.5 to 1.2% by weight of carbon, the balance being iron.

2. A self-lubricating wear-resistant iron base alloy as defined in claim 1, wherein the iron in said iron base alloy is electrolytic iron.

3. The self-lubricating wear-resistant iron base alloy as defined in claim 1, wherein said sulphur, selenium and carbon are in the form of molybdenum sulphide, molybdenum selenide, and molydenum carbide, respectively.

* * * * *